US007580870B1

(12) United States Patent
Chang

(10) Patent No.: US 7,580,870 B1
(45) Date of Patent: Aug. 25, 2009

(54) METHOD AND SYSTEM FOR PROVIDING AUCTIONS TO WIN WITH A LOWEST BID

(76) Inventor: Hsin-Wang Wayne Chang, 1606 Thornleaf Way, San Jose, CA (US) 95131

( * ) Notice: Subject to any disclaimer, the term of this patent is extended or adjusted under 35 U.S.C. 154(b) by 0 days.

(21) Appl. No.: 11/846,518

(22) Filed: Aug. 28, 2007

(51) Int. Cl.
*G06Q 30/00* (2006.01)

(52) U.S. Cl. ..... 705/26

(58) Field of Classification Search ..... 705/26, 705/27

See application file for complete search history.

(56) References Cited

U.S. PATENT DOCUMENTS

2007/0174171 A1* 7/2007 Sheffield ..... 705/37
2007/0174180 A1* 7/2007 Shin ..... 705/37
2008/0077500 A1* 3/2008 Linner et al. ..... 705/14

OTHER PUBLICATIONS

The online/mobile auction site provided by Limbo at the website www.41414.com on Jan. 6, 2006 a copy of which has been included in this Office Action.*

* cited by examiner

*Primary Examiner*—Jeffrey A Smith
*Assistant Examiner*—Courtney Stopp
(74) *Attorney, Agent, or Firm*—Joe Zheng

(57) ABSTRACT

Techniques for generating revenues from a bidding process that announces a winning bid that is lowest but unique among all bidders are disclosed. Opposite from a traditional auction in which the highest bid always wins, the present invention dictates a lowest and unique bid wins. A seller generates revenue by selling an item to the highest bidder in a traditional auction while a seller generates revenue from a bidding process of selling an item to the lowest and unique bidder in the present invention. In other words, the final sale price of an item in the present invention is no longer a significant portion of the revenue, the majority of the revenue comes from the process of bidding for the item by all participating bidders.

13 Claims, 4 Drawing Sheets

Item being auctioned: Retail Price $10,000 (Buy out price)
Increment: $10
Bidding fee: $1/each

| bids | Bidder Counts | bidding fees |
|---|---|---|
| $10 | 4500 | $4,500 |
| $20 | 3750 | $3,750 |
| $30 | 2300 | $2,300 |
| $40 | 1275 | $1,275 |
| $50 | 650 | $650 |
| $60 | 350 | $350 |
| $70 | 127 | $127 |
| $80 | 36 | $36 |
| **$100** | **1** | **$1** |
| $250 | 1 | $1 |
| $2500 | 1 | $1 |

Bid Winner Price: $100

*FIG. 2*

Total revenue:
$12,991

METHOD AND SYSTEM FOR PROVIDING AUCTIONS TO WIN WITH A LOWEST BID

BACKGROUND OF THE INVENTION

1. Field of the Invention

The present invention relates to the area of electronic commerce via various mediums, and particularly related to method and system for providing auctions to win with a lowest bid, where the bid must be unique.

2. Description of the Related Art

An auction is the process of buying and selling goods by offering them up for bidding, taking bids, and then selling an auctioned item to the winning bidder. Auctioning can be traced as far back as 500 B.C. In economic theory, an auction is a method for determining the value of a commodity that has an undetermined or variable price. Auctions can be done with reserve or minimum, or without minimums, or absolute or no reserve. In reserve auctions, there is a minimum bid or reserve price; if the bidding does not reach the minimum, there is no sale (but the person who puts the item up for auction may still owe a fee to the auctioneer or auction company). In absolute or no reserve auctions, the sale is guaranteed, with only the price left to be determined. In the context of auctions, a bid is an offered price.

There are many types of auctions, such as English auction, Chinese auction, Dutch auction, Sealed-bid first-price auction, Sealed-bid second-price auction, and All-pay auction. All of the auctions are revenue equivalent, meaning that they all result in the same expected revenue for a seller. The purchaser in the end is always a bidder who pays the highest price for an item among all bidders.

eBay (www.ebay.com) is a pioneer in online actions and provides probably the largest electronic auction platform that allows anyone who can access to the Internet to participate in bidding anything from a component to a vacation. The rules are simple. Before a deadline, whoever bids the highest price wins the item being auctioned. The auctioneer, eBay, gets a fractional fee out of the fee paid by the highest bidder, and the seller gets the rest.

One of the issues of selling items on eBay is that an item has to be sold if there is only one bidder regardless of the price offered by the bidder. With millions of items being auctioned on eBay, there is a likelihood that some items are deserted and draw far less bidding than they should have. As a result, the sellers may not maximize what they have hoped from auctioning their items.

The present invention discloses a different type of auction that announces a winning bid that is lowest but unique at the end of the auction.

SUMMARY OF THE INVENTION

This section is for the purpose of summarizing some aspects of the present invention and to briefly introduce some preferred embodiments. Simplifications or omissions in this section as well as in the abstract and the title may be made to avoid obscuring the purpose of this section, the abstract and the title. Such simplifications or omissions are not intended to limit the scope of the present invention.

The present invention pertains to a system, a mechanism, and a method for generating revenues from a bidding process that announces a winning bid that is lowest but unique among all bidders. Opposite from a traditional auction in which the highest bid wins, the present invention dictates the lowest and unique bid wins. A seller generates revenue by selling an item to the highest bidder in a traditional auction while a seller generates revenue from a bidding process of selling an item to the lowest and unique bidder in the present invention. In other words, the final sale price of an item in the present invention is no longer a significant portion of the revenue, the majority of the revenue comes from the process of bidding for the item by all participating bidders.

According to one aspect of the present invention, an electronic auction platform is established. The platform is running on one or more servers maintained by an auctioneer or an entity. All participating bidders, as long as they have access to the Internet, are charged a small fee for the opportunity to get an item being auctioned for the lowest prices possible, regardless of the actual market value of the item. Because of the possibility of getting the item far below its market value, more bidders will be tempted to bid for the item. The chances of getting duplicated bids are high, which in return drives the final sale price higher.

The present invention may be implemented in different forms including software, hardware or in a combination of both software and hardware. According to one embodiment, the present invention is a method for conducting an auction, the method comprises: receiving an item to be listed for auctioning; specifying a set of requirements including a deadline for the item; validating a bid from a bidder for the item after the bidder pays a bidding fee; and determining whether the bid is currently lowest and also unique, wherein the item is won only when a bid for the item is a lowest but unique bid upon the deadline.

According to another embodiment, the present invention is a module stored in a computer readable medium, the module when executed by a processor, conducts an auction, the module comprises program code for receiving an item to be listed for auctioning; program code for specifying a set of requirements including a deadline for the item; program code for validating a bid from a bidder for the item after the bidder pays a bidding fee; and program code for determining whether the bid is currently lowest and also unique, wherein the item is won only when a bid for the item is a lowest but unique bid upon the deadline.

One of the objects, features, advantages, benefits of the present invention is to allow a seller taking advantages of bidders keeping bidding to reach a lowest but unique bid so as to collect bidding fees.

Other objects, features, advantages, benefits of the invention will become more apparent from the following detailed description of a preferred embodiment, which proceeds with reference to the accompanying drawings

BRIEF DESCRIPTION OF THE DRAWINGS

The present invention will be readily understood by the following detailed description in conjunction with the accompanying drawings, wherein like reference numerals designate like structural elements, and in which:

FIG. 2 shows an example of auctioning a car in accordance with one embodiment of the present invention;

DETAILED DESCRIPTION OF THE INVENTION

In the following description, numerous specific details are set forth to provide a thorough understanding of the present invention. The present invention may be practiced without these specific details. The description and representation herein are the means used by those experienced or skilled in the art to effectively convey the substance of their work to others skilled in the art. In other instances, well-known methods, procedures, components, and circuitry have not been described in detail since they are already well understood and to avoid unnecessarily obscuring aspects of the present invention.

Reference herein to "one embodiment" or "an embodiment" means that a particular feature, structure, or characteristic described in connection with the embodiment can be included in at least one implementation of the invention. The appearances of the phrase "in one embodiment" in various places in the specification are not necessarily all referring to the same embodiment, nor are separate or alternative embodiments mutually exclusive of other embodiments. Further, the order of blocks in process, flowcharts or functional diagrams representing one or more embodiments do not inherently indicate any particular order nor imply limitations in the invention.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

Figure 1:
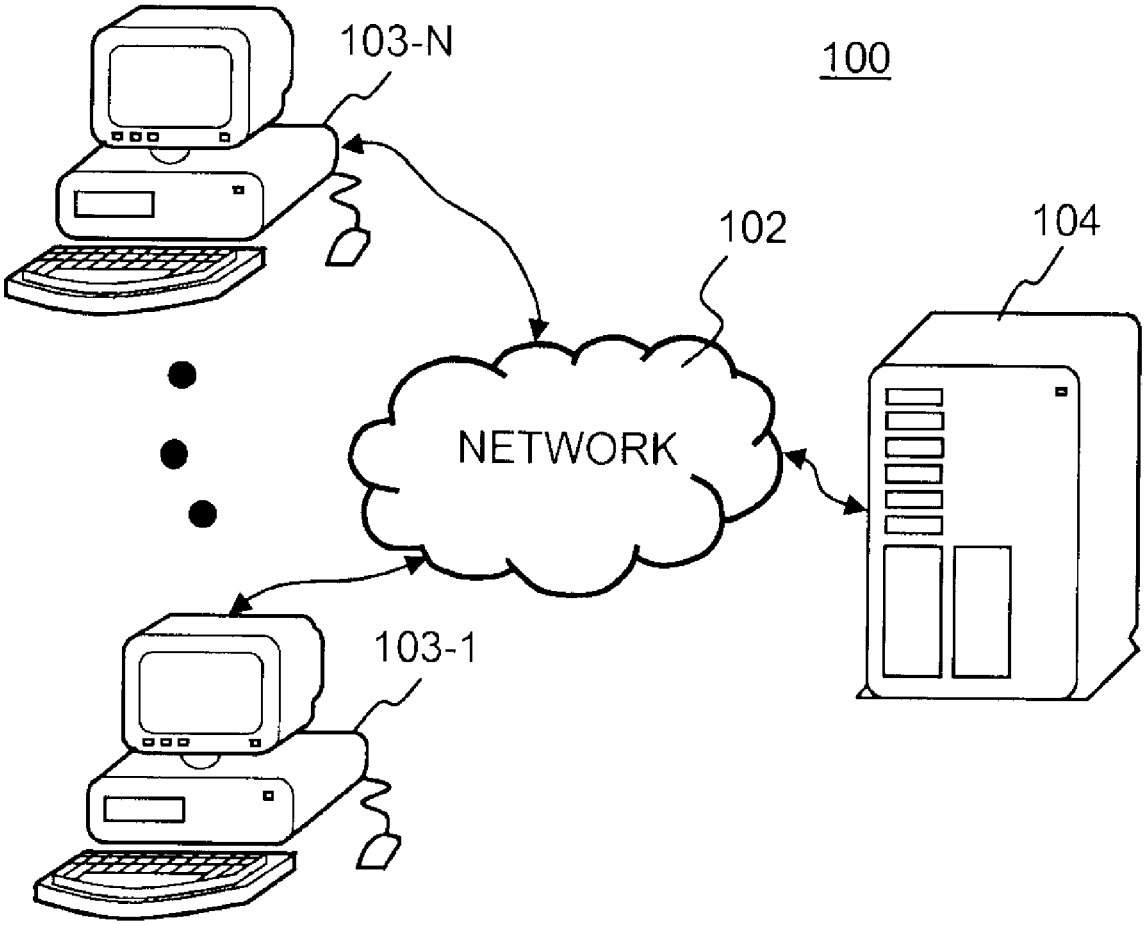
FIG. 1 shows an exemplary configuration in which the present invention may be practiced.

Referring now to the drawings, FIG. 1 shows an exemplary configuration 100 in which the present invention may be practiced. The network 102 may be a local area network (LAN), wide area network (WAN) or a combination of both LAN and WAN, wired and/or wireless. The client machines 103-1 . . . 103-N are representation of users are able to access the network 102 and participate auctions being held by a server 104. Depending on the number of bidders or sellers, collectively referred to as users, that desire to do transactions through the auctions, the server 104 may represent a single server or a cluster of servers. In one embodiment, the server 104 is operated by an auctioneer or an entity that draws a percentage of fees generated from the transactions conducted on the server 104.

From one perspective, an electronic or digital auction platform contemplated in the present invention is hosted by the server 104. Users or their computing devices (e.g., various computers, cellphones, and PDA) can access the platform and participate in bidding for items they hope to obtain. The auction platform may also be held via other mediums such TV or radio stations to allow users to call in to place items for auctions or bid for the items. Essentially, the auction platform can be designed to accept placements or bids in all forms, directly or indirectly.

FIG. 2 shows an example of auctioning a car in accordance with one embodiment of the present invention. It is assumed that the car being auctioned has a market value of $10,000. When a seller lists the car with an auctioneer via server (e.g., the server 104 of FIG. 1), the seller may be given an opportunity to specify a deadline by which the auction will be closed and an increment. In some case, the seller may specify a minimum bid that can win. The minimum bid can be zero, in which case a bidder can get the car for free in some sense. The seller may also list a "buy out" option with a price, in which case the car may be sold at the listed price without going through the bidding process.

Depending on implementation, the deadline may be automatically determined or manually determined. Usually, the time frame to the deadline varies (e.g., 1 day, 3, days or 7 days). In one embodiment, the deadline may be automatically extended should there be not a lowest but unique bid. The increment is an increment a bidder places over a previous bid. Depending on implementation, the increment may also be automatically or manually determined with or without a reference to a market value.

Because the theme of the auction is to sell the car to the bidder who has the lowest but unique bid, there could be a large number of bidders to participate the auction. For example, if a first bidder offers a bid of $10 for the car being auctioned, a second bidder offers a bid of $20 for the car, the first bidder is a temporary winner. If a third bidder offers a bid of $10 for the car, the first bidder is no longer is a winner as the bid is no longer unique, thus the second bidder offering the bid of $20 for the car becomes a temporary winner. In one embodiment, both the first and third bidders are offered to place another bid to outbid the current bid. If both of the first and third bidders place a bid of $30 for the car, they will be notified their bidders do not make them a temporary winner because there bidders are not unique. Accordingly, the second bidder offering the bid of $20 for the car is still the temporary winner.

One of the advantages, benefits and objects in the present invention is to keep the bidders bidding for the lowest or unique bid for the item being auctioned. The auctioneer or the seller of the item benefits from the bidding process by collecting a small bidding fee. As shown in FIG. 2, it seems to be a great bargain to place bids of tens of dollars for an item valued $10,000. The increment is limited to $10 while the bidding (handling) fee is $1/bid. The lowest bidder is $10 that could attract a large number of bidders. In the hypothetical example shown in FIG. 2, there are 4500 bidders who have placed an offer of $10 for the $10000 car, resulting in a collection of $4,500 bidding fee. Because the $10 bids are not unique, some bidders increases their bids to $20, which may reduces the number of bidders but still generates $3,700 bidding fee. The bids keep increased as bidders hope to reach a bid that no one else would place a similar bid. At $100, there remains only one bidder. However, another bidder wants to outbid the $100 bidder by placing $200, which however is not the lowest. The $100 bidder remains as a temporary winner unless the deadline for the auction arrives. Therefore any further increase in the bidding is not going to help the bidder. One way to outbid the temporary winner is to place an identical bid that invalidates the current lowest but unique bid and follow with another unique bid. In any case, unlike the traditional auction, the final bid offered to buy the car is not of significant. The bidding fees collected would make all the differences lost in the lowest but unique bid. As a result, the auction of the car shown in FIG. 2 generates revenue often more than the market value of the car, considerably benefiting the seller.

Figure 3:
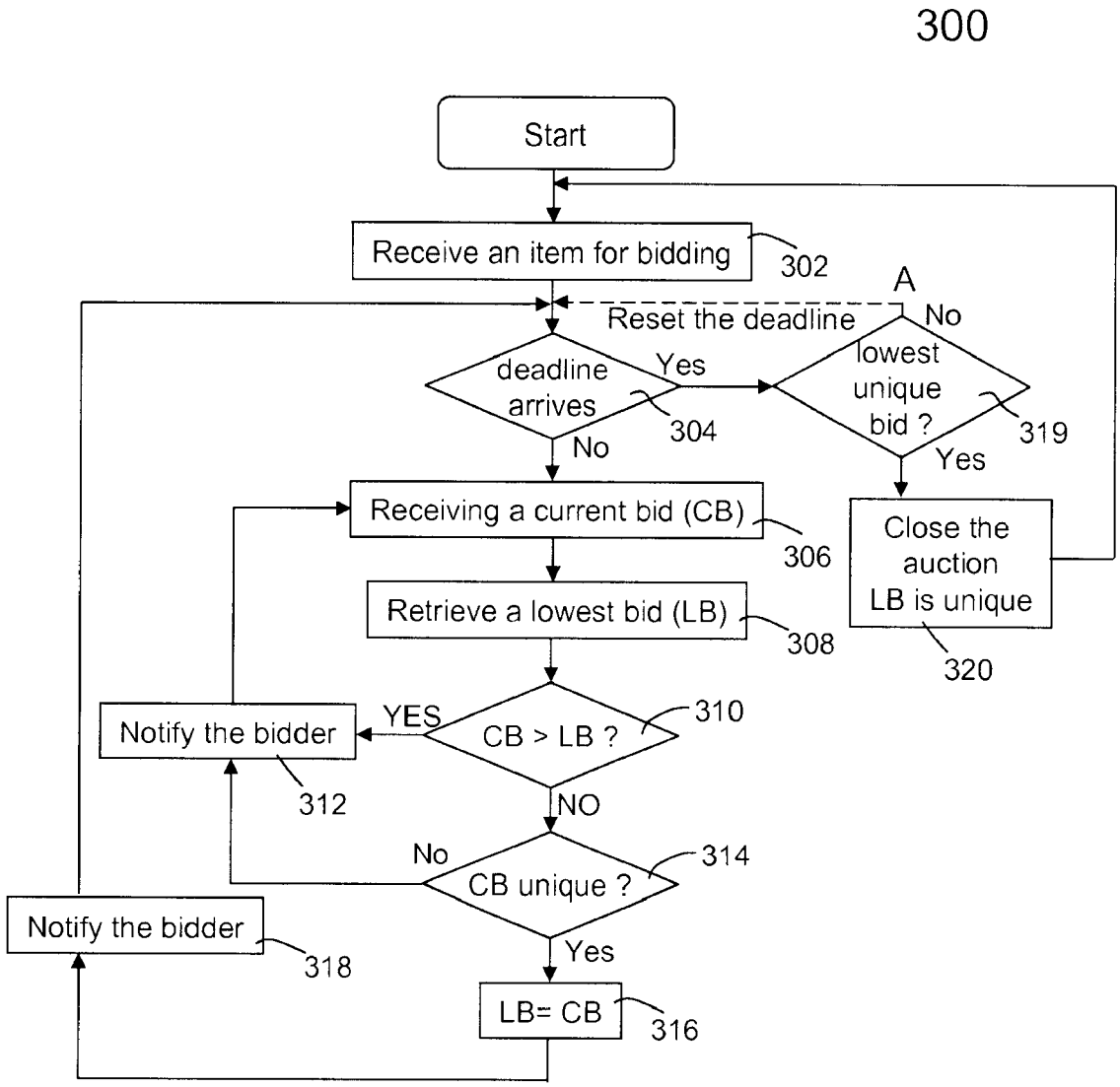
FIG. 3 shows a flowchart or process of keeping bidders to place bids for the lowest but unique bid.

FIG. 3 shows a flowchart or process 300 of bidding for the lowest but unique bid. The process 300 may be implemented in software, hardware or a combination of bother software and hardware. In one embodiment, the process 300 is implemented in a module that is executed in a server that hosts a website. Users may browse the website for deals or interesting items. The website allows access from all types of computing devices, such as laptops, cellular phones, or PDAs. Users may place bids in an HTTP request, an instant message, a short message, email, or a phone call. Likewise, winning or losing notification may be sent out by the server in all means (e.g., an HTTP response, an instant message, a short message, email, or a phone call).

The process 300 starts whenever a seller places an item for auction and is willing to take the lowest but unique bid. At 302, the seller lists an item for auction. The seller may be notified all charges (e.g., listing fees, bidding fees, a percentage charge to the wining bid, etc.) and various options (e.g., buyout price). In particular, the seller may specify an increment and a minimum bid (e.g., at the first increment). Typically, a deadline needs to be specified so that prospective bidders know when the auction of the item ends. In one embodiment, the seller is offered to extend the deadline once or twice if there is not a valid lowest but unique bid. In another embodiment, the seller is asked to consent to sell the item to the most active bidder who has bid the most times and at the price of the highest bid in the bidding history of this most active bidder in this auction. In a case, there are more than one bidder equally identified as the most active bidder, the bidder with a lower highest bid wins the auction. In a less likely case, if there are still more than one bidder that have placed the most biddings with the same highest bid price, then whoever has the second highest bid price wins. In an even less likely case, if the second bids are still the same, then subsequent bids are respectively compared, till their very last bid. Whoever has a higher highest bid price wins. In a very unusual bidding case in while the bidding profiles of the two or more bidders are all the same, then the auctioneer (e.g., the system) picks the one whose last bid is closer to the deadline to win.

The process 300 checks for the deadline at 304. If the deadline has not arrived, the action continues, and the process 300 goes to 306 where at least a bid is assumed to have been received from a bidder who has paid a bidding fee. The bid is a current bid (CB). At 308, a current lowest bid (LB) is retrieved. It is assumed that an LB exists. Depending on where in the bidding process, LB may be a value specified by the seller if the CB is the first bid, a lowest but unique bid so far from the ongoing bidding process, or the current bid is taken as an LB if there is no LB in which case.

At 310, the process 300 determines whether CB>LB. If CB>LB, which means the current bid is higher than the current lowest bid, the bid just placed by the bidder is no good. The process 300 goes to 312 where the bidder is notified that the bid just placed did not make him/her a temporary winner. The bidder may place another bid lower than the bid he/she just placed. The process 300 goes to 306 and receives a new bid. Again the current LB is retrieved for comparison with the revised bid. Because the bidder placed a revised bid lower than the current LB, it is assumed that the revised bid is lower than or equal to LB, the process 300 moves from 310 to 314, where the uniqueness of the bid is checked. If the revised bid is equal to LB, the revised bid just invalidates the LB but at the same time fails to make a wining bid because it is not unique. When an LB is invalidated, whatever a next bid is, as long as it is not identical to any of the previous bids, the next bid is assigned to be an LB at 316, which is assumed before the deadline comes.

In any case, the process 300 now goes from 314 to 312 to notify the bidder who may revise the bid and place another one. If the revised bid is smaller than LB and also unique at 314, LB is now CB, namely the lowest bid is now set to the revised bid. The process 300 goes to 318 to notify the bidder that the revised bid is now a temporary wining bid. The process 300 further goes to 306, if the deadline has still not arrived, to accept new bids. At a certain point, the deadline finally comes, the process 300 goes from 304 to 319 to determine if there is a lowest but unique bid available. If there is indeed one in existence, the process 300 concludes the auction of the listed item at 320. Whoever has the lowest but unique bid wins the auction and gets the list item for the price of the lowest but unique bid (after paying all other agreed charges).

However, the process 300 may also indicate at 319 that there is not a valid lowest but unique bid (e.g., a lowest but unique bid was just invalidated by an identical bid placed a moment ago). Depending on implementation and an option chosen by the seller, the process 300 may be configured to reset the deadline to continue the auction or perform an arbitration process to determine a winner. If the deadline is reset, the process 300 goes back to 304 to continue the bidding process till the deadline arrives.

Figure 4:
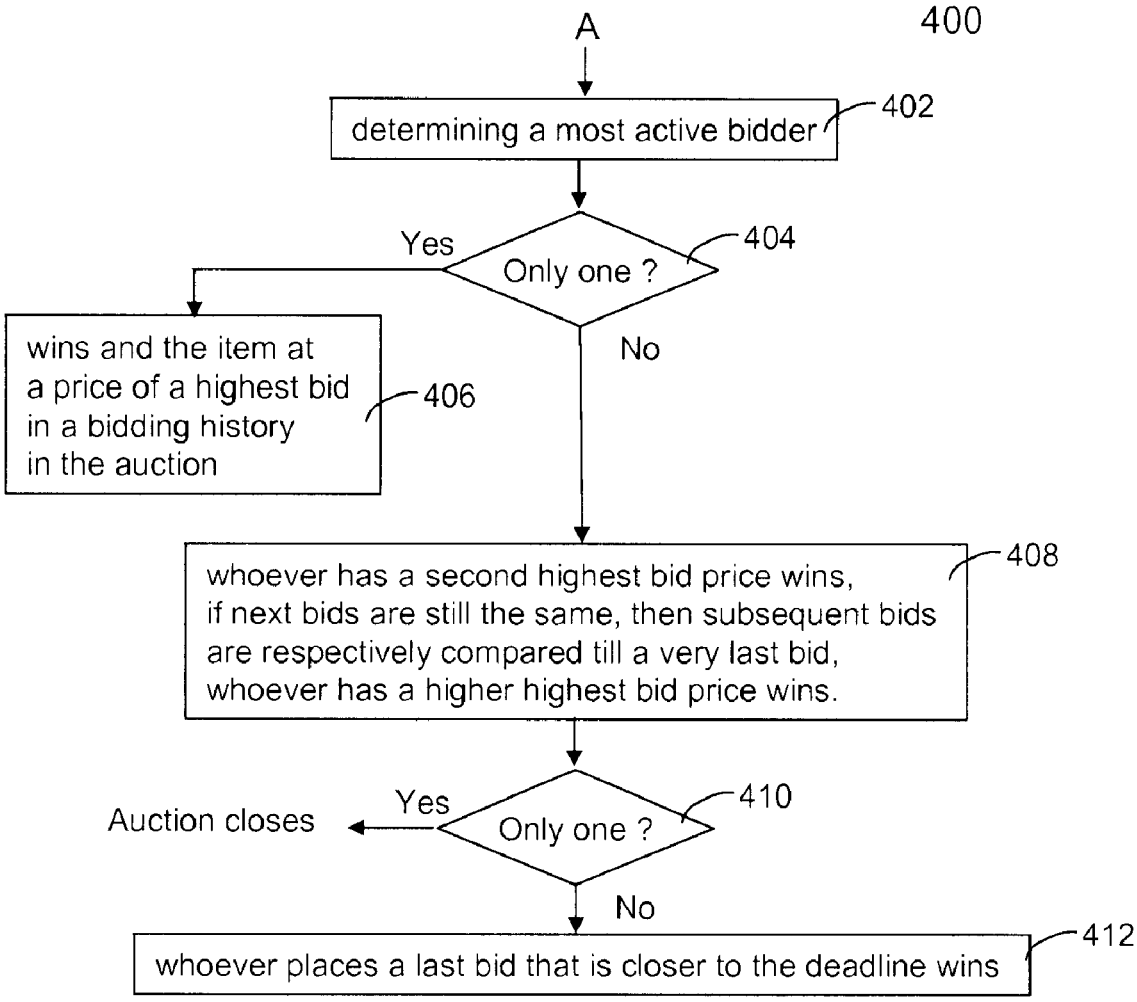
FIG. 4 shows a flowchart or process of determining a final wining bidder in an event there are multiple identical bids.

In any case, the arbitration process is configured to perform in steps. If any one of the steps determines a winner, the auction closes. It is understood that the auction could not be closed because a valid lowest but unique bid was invalidated by another identical bid. The process 300 as indicated at 319 as a branch A is configured to determine the most active bidder who has bid the most times. If there is only one such a bidder, the most active bidder wins and gets the list item at the price of the highest bid in the bidding history of this most active bidder in this auction. FIG. 4 shows a flowchart or process 400 of determining a final wining bidder in an event there are multiple identical bids. As shown in FIG. 4, the process 400 is initiated when there is a need to determine a most active bidder at 402. At 404, the number of the bidders is checked. If there is only one most active bidder, this one wins the item at a price of a highest bid in a bidding history in the auction. If there are more than one most active bidders, whoever has a second highest bid price wins. If next bids are still the same, then subsequent bids are respectively compared till a very last bid, whoever has a higher highest bid price wins. The number of the bids is checked again, at this time, if the bid is the only one left, the auction is then closed. If there are still identical bids, whoever places a last bid that is closer to the deadline wins.

In a case, there are more than one bidder equally identified as the most active bidder, the bidder with a lower highest bid wins the auction. In a less likely case, if there are still more than one bidder that have placed the most biddings with the same highest bid price, then whoever has the second highest bid price wins. In an even less likely case, if the second bids are still the same, then subsequent bids are respectively compared, till their very last bid. Whoever has a higher highest bid price wins. In a very unusual bidding case in while the bidding profiles of the two or more bidders are all the same, then the auctioneer (e.g., the system) picks the one whose last bid is closer to the deadline to win. In the end, a win bid is determined.

Depending on implementation, a bidder may maintain an account with the auctioneer or allow the auctioneer to access a charge means. In one embodiment, the account is funded with a certain amount and a bidding fee is deducted from the account. A bid is only valid when a corresponding fee is collected.

One skilled in the art will recognize that elements of the system may be implemented in software, but can be implemented in hardware or a combination of hardware and software. The invention can also be embodied as computer-readable code on a computer-readable medium. The computer-readable medium can be any data-storage device that can store data which can be thereafter be read by a computer system. Examples of the computer-readable medium may include, but not be limited to, read-only memory, random-access memory, CD-ROMs, DVDs, magnetic tape, hard disks, optical data-storage or devices. The computer-readable media can also be distributed over network-coupled computer systems so that the computer-readable code is stored and executed in a distributed fashion.

The present invention has been described in sufficient detail with a certain degree of particularity. It is understood to those skilled in the art that the present disclosure of embodiments has been made by way of examples only and that numerous changes in the arrangement and combination of parts may be resorted without departing from the spirit and scope of the invention as claimed. While the embodiments discussed herein may appear to include some limitations as to the presentation of the information units, in terms of the format and arrangement, the invention has applicability well beyond such embodiment, which can be appreciated by those skilled in the art. Accordingly, the scope of the present invention is defined by the appended claims rather than the forgoing description of embodiments.

I claim:

1. A method for conducting an auction to win with a lowest but also unique bid, the method comprising:

a server receiving an item to be listed for auctioning via the server;

specifying in the server a set of requirements including a deadline for the item;

validating in the server a bid from a bidder for the item after the bidder pays a bidding fee;

collecting bidding fees every time respective bidders place bids for the lowest bid;

determining in the server whether the bid is currently lowest and also unique, wherein the item is won only when the bid for the item is a lowest but unique bid upon the deadline, where a value of the item through the auction includes the currently lowest but also unique bid plus the bidding fees; and determining a most active bidder who has bid the most number of times and wins the item at a price of a highest bid in a bidding history of the most active bidder in the auction when there are multiple bidders that offer identical bids being currently lowest.

2. The method as recited in claim 1, wherein the requirements include an increment and how much the bidding fee is, where the increment is an amount the bidder places over a previous bid.

3. The method as recited in claim 2, wherein said validating a bid from a bidder for the item comprises looking up a valid means to charge the bidding fee; and collecting the bidding fee successfully.

4. The method as recited in claim 3, wherein said determining whether the bid is currently lowest and also unique comprises:

retrieving a currently lowest and also unique bid if there is one;

comparing the bid with the currently lowest and also unique bid;

if the bid is larger than the currently lowest and also unique bid, notifying the bidder that the bid just placed is no good;

if the bid is smaller than the currently lowest and also unique bid, notifying the bidder that the bid just placed is accepted; and resetting the bid to be the currently lowest and also unique bid;

if the bid is equal to the currently lowest and also unique bid, invalidating the currently lowest and also unique bid;

notifying the bidder that the bid just placed is no good; and notifying a bidder who owns the currently lowest and also unique bid that has just been invalidated that a temporary wining bid is no longer valid.

5. The method as recited in claim 4, wherein said determining whether the bid is currently lowest and also unique further comprises:

comparing the bid with other received bids, and;

assigning the bid to be the currently lowest and also unique bid if the bid is lower than the other received bids.

6. The method as recited in claim 1, wherein, in a case there are more than one bidder equally identified as the most active bidder, a bidder with a lower highest bid wins the auction, if there are still more than one bidder that have placed the most biddings with an identical highest bid price, then whoever that has a second highest bid price wins.

7. The method as recited in claim 6, wherein if two or more bidders happen to have similar bidding histories, then whoever places a last bid that is closer to the deadline wins.

8. A module stored in a computer readable medium, the module when executed by a processor, conducting an auction to win with a lowest but also unique bid, the module comprising:

program code for receiving an item to be listed for auctioning; program code for specifying a set of requirements including a deadline for the item;

program code for validating a bid from a bidder for the item after the bidder pays a bidding fee;

program code for collecting bidding fees every time respective bidders place bids for the lowest bid;

program code for determining whether the bid is currently lowest and also unique, wherein the item is won only when a bid for the item is a lowest but unique bid upon the deadline, where a value of the item through the auction includes the currently lowest but also unique bid plus the bidding fees; and program code for determining a most active bidder who has bid the most number of times and wins the item at a price of a highest bid in a bidding history of the most active bidder in the auction when there are multiple bidders that offer identical bids being currently lowest.

9. The module as recited in claim 8, wherein the requirements include an increment and how much the bidding fee is, where the increment is an amount the bidder places over a previous bid.

10. The module as recited in claim 9, wherein said program code for validating a bid from a bidder for the item comprises program code for looking up a valid means to charge the bidding fees; and program code for collecting the bidding fee successfully.

11. The module as recited in claim 10, wherein said determining whether the bid is currently lowest and also unique comprises:

program code for retrieving a currently lowest and also unique bid if there is one;

program code for comparing the bid with the currently lowest and also unique bid;

if the bid is larger than the currently lowest and also unique bid, program code for notifying the bidder that the bid just placed is no good;

if the bid is smaller than the currently lowest and also unique bid, program code for notifying the bidder that the bid just placed is accepted; and program code for resetting the bid to be the currently lowest and also unique bid;

if the bid is equal to the currently lowest and also unique bid, program code for invalidating the currently lowest and also unique bid;

program code for notifying the bidder that the bid just placed is no good; and program code for notifying a bidder who owns the currently lowest and also unique bid that has just been invalidated that a temporary wining bid is no longer valid.

12. The module as recited in claim 11, wherein said program code for determining whether the bid is currently lowest and also unique further comprises:

program code for comparing the bid with other received bids, and program code for assigning the bid to be the currently lowest and also unique bid if the bid is lower than the other received bids.

13. The module as recited in claim 8, wherein an auction server is established for attracting more bidders for the item to be won for a lowest but unique bid.

* * * * *